United States Patent [19]

Lewis

[11] Patent Number: 4,724,406

[45] Date of Patent: Feb. 9, 1988

[54] DEVICE FOR ATTENUATING NOISE IN ELECTRICAL APPARATUS

[76] Inventor: Francis H. Lewis, 33 E. Main St., Beacon, N.Y. 12508

[21] Appl. No.: 887,281

[22] Filed: Jul. 21, 1986

[51] Int. Cl.[4] ..... H01P 1/22

[52] U.S. Cl. ..... 333/12; 333/81 R; 333/81 A

[58] Field of Search ..... 333/81 R, 81 A, 81 B, 333/22 R, 246, 12; 381/94, 74; 338/66, 216, 217

[56] References Cited

U.S. PATENT DOCUMENTS 2,837,720 6/1958 Saltzman et al. ..... 333/22 R
3,555,485 1/1971 Solow ..... 361/402 X

FOREIGN PATENT DOCUMENTS 0866321 4/1961 United Kingdom ..... 333/22 R

*Primary Examiner*—Eugene R. Laroche
*Assistant Examiner*—Seung Ham
*Attorney, Agent, or Firm*—Ostrolenk, Faber, Gerb & Soffen

[57] ABSTRACT

The present invention relates to an attenuator for reducing noise and distortion, preferably in the audio frequency range. Briefly stated, the present invention is comprised of two wedge shapes in one block with two axially opposing leads connected to the wedge shape midway along the line formed by the intersection of two adjacent sides. The leads are preferably bent at 90° and connected to attenuator conductive strips contained on a circuit board. The attenuator conductive strips on the circuit board are preferably at 90° with respect to parallel conductive strips connected to a speaker or the like. The entire attenuator structure is preferably covered with an insulative or dielectric material.

10 Claims, 9 Drawing Figures

FIG. 3a.
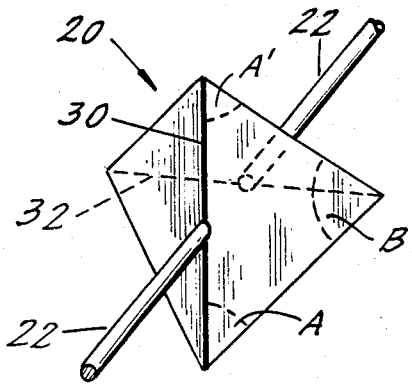
FIG. 3b.
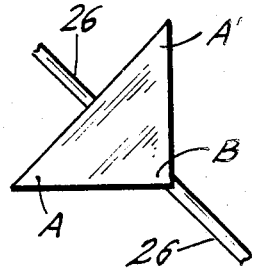
FIG. 4c.
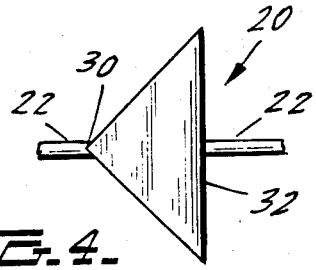
FIG. 4.
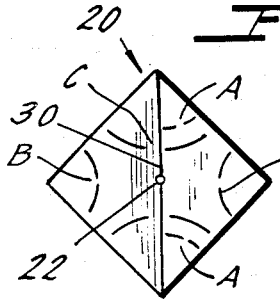
FIG. 4a.
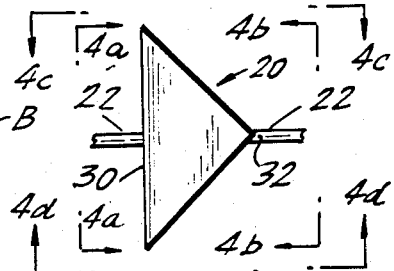
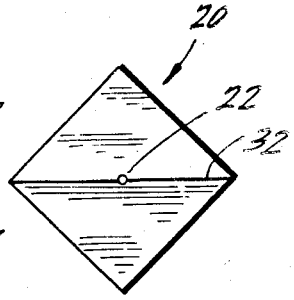
FIG. 4b.
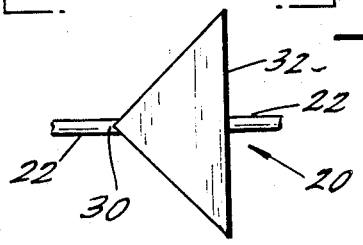
FIG. 4d.

DEVICE FOR ATTENUATING NOISE IN ELECTRICAL APPARATUS

BACKGROUND OF THE INVENTION

This invention relates, generally, to the reduction of noise in electrical circuits and more particularly to a device for reducing/suppressing noise in electrical circuits such as audio circuits.

Since the inception of audio electronics, i.e. radios, stereos, tapeplayers and the like, distortion or unwanted sound in the form of noise has been a constant problem and consideration. The problems are complex and have hereto been difficult to solve since noise is generally the result of a cumulative affect in the circuit, although some portions of any apparatus may present more problems than others.

Solving this problem has been somewhat of an evolutionary process which has encompassed better circuit design, improved component layout, higher quality components and the like. Some approaches try to minimize the production of noise while others attempt to supress noise downstream of its production. Some schemes attempt to use parametric amplifiers, shielding or filters in order to fulfill the goal of noise free sound reproduction.

However, while great progress has been made, the production of noise is inevitable since no component, circuit or scheme is ideal.

Further, many schemes are relatively expensive to design, manufacture and install and are also generally not amenable to retrofitting. Also, since these schemes utilize active components or directly interact with active components, they themselves are subject to the production of noise. Additionally, each solution is inherently unique to each application.

SUMMARY OF THE INVENTION

It is an object of the present invention to produce an attenuating device which is inexpensive to manufacture and install. It is another object of the present invention to produce a device which does not have to be designed for each individual application. It is still a further object of the present invention to produce a device which is passive and does not require that it be directly interconnected with active components.

Another object of the present invention is to produce a device which is retrofittable to existing circuits as well as being useable over a wide variety of situations.

It is yet another object of the present invention to produce an electrical noise attenuator for use in an electrical circuit having signal carrying conductors therein, comprising an electrically conductive attenuator block having at least four planar sides and at least six edges, each edge being formed by the intersection of any two planar sides, a first electrically conductive wire having a first end and a second end, the first end connected to a first edge of the attenuator block, a second electrically conductive wire having a first end and a second end, the first end axially spaced from the first end of the first conductive wire and being connected to a second edge of the attenuator block, a first attenuator conductive strip connected to the second end of the first electrically conductive wire, and a second attenuator conductive strip connected to the second end of the second electrically conductive wire, the second attenuator conductive strip axially disposed from the first attenuator conductive strip, wherein the first and the second attenuator conductive strips are disposed adjacent the signal carrying conductors contained in the electrical circuit.

BRIEF DESCRIPTION OF THE DRAWING

Reference may be now had to accompanying drawings in which:

FIGS. 3A and 3B are a perspective and side view respectively of the attenuation block of the present invention; and FIGS. 4, 4A–4D show different sides of the attenuator block of the present invention.

DESCRIPTION OF THE PREFERRED EMBODIMENT

Figure 1:
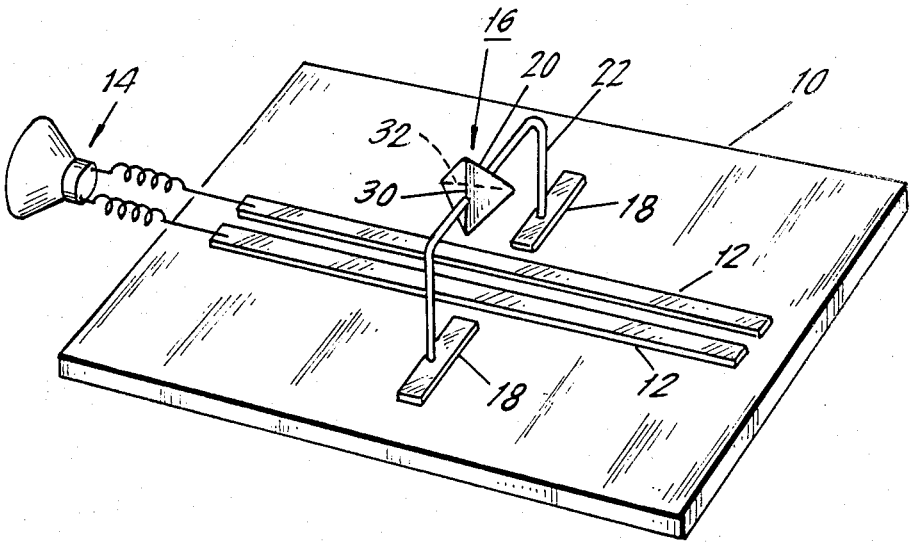
FIG. 1 is an isometric view of the present invention as used in conjunction with an audio circuit.

Referring now to FIG. 1, an illustration which is representative of use of the present invention may be seen. It is to be understood that the present invention is preferably used to attenuate noise in audio frequency circuits, although noise attenuating for other ranges or frequencies can and may be utilized without departing from the spirit and scope of the present invention. It is also contemplated that the present invention is preferably used adjacent the final output amplifier in audio apparatus. This audio apparatus may include, for example, radios, audio and video tape players, stereos systems and the like. However, the present invention may be utilized in earlier stages of any amplification network.

Shown, is a circuit board 10 which may be part of a larger circuit board. Conductive strips 12 which are traces on circuit board 10 are placed adjacent each other and thereafter connected to speaker 14. Also disclosed on circuit board 10 is attenuator 16 of the present invention. Attenuator 16 is connected to attenuator conductive strips 18 which are preferably perpendicular to and near but not in contact with conductive strips 12. The attenuator 16 is generally comprised of a three dimensional four sided polygon wherein each of the sides is preferably of equal size and shape. Lead wires 22 emanate from attenuator block 20 and are connected to attenuator conductive strips 18. The lead wires 22 are connected to attenuator block 20 so as to be axially opposed from each other and are connected at first edge 30 and second edge 32 of attenuator block 20.

It has been found that the orientation shown in FIG. 1 provides for optimum noise attenuation. The orientation of the attenuator 16 should preferably be perpendicular to conductive strips 12, although other angles can be used but will generally result in lower noise attenuation than the orientation shown. Conductive strips 12 should preferably be parallel to each other and should pass under attenuator 16. It has been observed that the height of attenuator 16 from circuit board 10 is not critical although a distance which is more than two or three orders of magnitude of the height of attenuator block 20 does decrease the benefits of attenuator 16. While the dimensions are not critical, it has been found that optimum results are obtained when they are within the mentioned tolerances. Further, and as mentioned, it is preferred that conductive strips 12 carry the audio frequency components of a sound signal. By use of attenuator 16 in the configuration shown, noise and distortion present at speaker 14 is greatly reduced as compared to the same apparatus prior to use of attenuator 16.

Figure 2:
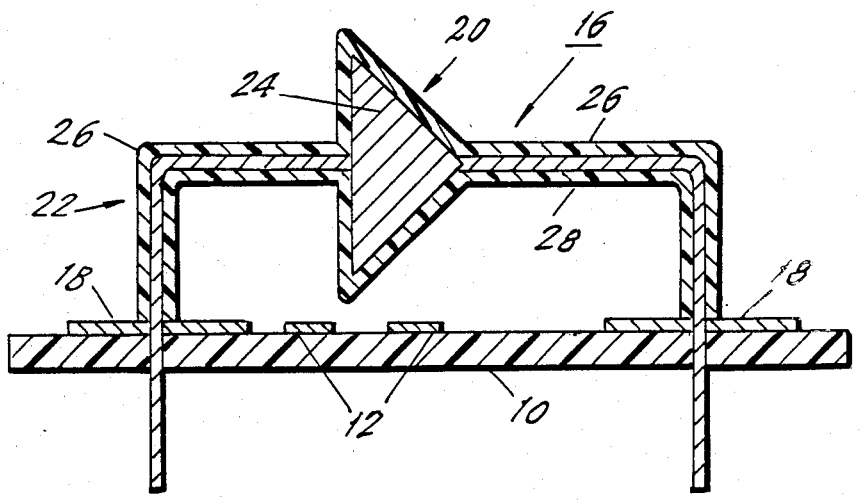
FIG. 2 is a cross-sectional view taken through FIG. 1 showing more detail.

Referring now to FIG. 2 a cross-sectional view taken through FIG. 1 is shown. It may now be seen how lead wires 22 are disposed midway along each corner or edge of attenuator block 20. Also evident is how almost the entire attenuator apparatus 16 is covered by an insulator/dielectric 26 which covers core 24 of attenuator block 20 as well as conductive wires 28 of lead wires 22. It has been found that optimum results can be obtained by insulating the entire outer area as close to conductive strips 18 as is possible. It has further been found that the conductive wires 28 should preferably emanate from the core 24 in right angles thereto. The conductive wires 28 may be of any suitable conductive material and are preferably copper. The core 24 is preferably lead although any suitable conductive material such as, for example, lead, copper, steel, aluminum or the like may be used. It has been found that it also not required that conductive wires 28 be of the same material as the core 24. It is preferable but not required that lead wires 22 be bent at right angles for presentation to conductive strips 18. Additionally, it is preferred that conductive wires 28 pass through circuit board 10. The length which they should extend through circuit board 10 has been found to be nonthrough critical and is typically the length of other leads on printed circuit boards. It is not required that the attenuator block be centrally disposed between the conductive strips 18 as is shown in FIG. 2 and it is similarly non-critical that conductive block 20 be centrally disposed over conductive strip 12. However, it has been found that "symmetry" of the orientation of the attenuator 16, with respect to conductive strips 12, 18, although non-critical, is sensitive to orders of magnitude of deviation.

Referring now to FIGS. 3A, 3B and FIGS. 4, 4A–4D, the orientation of the different sides of the attenuator block may be more clearly seen. It has been found that optimum results are generally obtained when each side of block 20 is equal. Further, it has been found that A and A′ are preferably 45° which therefore dictates that angle B and B′ are 90°. Similarly, angles C and C′ should also be 90°. Further, lead wires 22 are preferably placed on an edge between two adjacent sides and midway along the length of the edge, with one lead wire axially opposed, that is, 180° from the remaining lead wire. However, it is to be understood the lead wires 22 do not have to be exactly in alignment as mentioned or that attenuator block 20 have equal sides for the present invention to work. It has been observed however that the angular and spacial relationships mentioned offer optimum results and that deviation therefrom will result in lower perfromance. It is also been observed that the use of a four sided polygon for an attenuator block 20 is preferred since polygons having other numbers of sides, although workable, do not seem to perform as well.

It is to be understood that many variations in the present invention may be practiced without departing from the spirit and scope of the present invention. For example, substrates other than printed circuit boards may be utilized while wires instead of attenuator conductor strips may be used. Further, bending of the lead wires can be made in a different manner while the insulation disposed on the attenuator need not extend fully to the attenuator conductive strips.

Although the present invention has been described in connection with a preferred embodiment thereof, many other variations and modifications will now become apparent to those skilled in the art. It is preferred, therefore, that the present invention not be limited by the specific disclosure herein, but only by the appended claims.

What is claimed is:

1. An electrical noise attenuator for use in an electrical circuit having signal carrying conductors therein, comprising:

an electrically conductive attenuator block having at least four planar sides and at least six edges, each said edge being formed by the intersection of any two of said planar sides;

a first electrically conductive wire having a first end and a second end, said first end connected to a first edge of said attenuator block;

a second electrically conductive wire having a first end and a second end, said first end axially spaced from said first end of said first conductive wire and being connected to a second edge of said attenuator block;

a first attenuator conductive strip connected to said second end of said first electrically conductive wire; and a second attenuator conductive strip connected to said second end of said second electrically conductive wire, said second attenuator conductive strip axially disposed from said first attenuator conductive strip, wherein said first and said second attenuator conductive strips are disposed adjacent said signal carrying conductors contained in said electrical circuit.

2. An electrical noise attenuator for use in an electrical circuit having signal carrying conductors therein, according to claim 1 wherein said first attenuator conductive strip and said second attenuator conductive strip are perpendicular to said signal carrying conductors.

3. An electrical noise attenuator for use in an electrical circuit having signal carrying conductors therein, according to claim 1 wherein said signal carrying conductors are disposed between said first attenuator conductive strip and said second attenuator conductive strip.

4. An electrical noise attenuator for use in an electrical circuit having signal carrying conductors therein, according to claim 1 further comprising an insulating material disposed around said attenuator block, said first and said second conductive wires.

5. An electrical noise attenuator for use in an electrical circuit having signal carrying conductors therein, according to claim 1 wherein said signal carrying conductors and said first and said second conductive strips are disposed on a circuit board.

6. An electrical noise attenuator for use in an electrical circuit having signal carrying conductors therein, according to claim 1 wherein said signal carrying conductors are parallel to each other.

7. An electrical noise attenuator for use in an electrical circuit having signal carrying conductors therein, according to claim 1 wherein each side of said attenuator block is triangular in shape having two angles which are approximately 45°.

8. An electrical noise attenuator for use in an electrical circuit having signal carrying conductors therein, according to claim 1 wherein said first electrically conductive wire and said second electrically conductive wire are disposed at the midpoint of said first edge and said second edge respectively.

9. An electrical noise attenuator for use in an electrical circuit having signal carrying conductors therein, according to claim 1 wherein said first and said second electrically conductive wires are perpendicularly disposed with respect to said first edge and said second edge.

10. An electrical noise attenuator for use in an electrical circuit having signal carrying conductors therein, according to claim 8 wherein said first and said second electrically conductive wires are perpendicularly disposed with respect to said first edge and said second edge.

* * * * *